US008651090B2

(12) United States Patent
Solferino et al.

(10) Patent No.: US 8,651,090 B2
(45) Date of Patent: Feb. 18, 2014

(54) BEVELED DAMPENING ELEMENT FOR A FUEL INJECTOR

(71) Applicant: Ford Global Technologies, LLC, Dearborn, MI (US)

(72) Inventors: Vince Paul Solferino, Dearborn, MI (US); Paul Zeng, Inkster, MI (US); Patrick Brostrom, Clarkston, MI (US); Giuseppe DeRose, Jr., Canton, MI (US); Scott Lehto, Walled Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/926,718

(22) Filed: Jun. 25, 2013

(65) Prior Publication Data

US 2013/0284153 A1 Oct. 31, 2013

Related U.S. Application Data

(63) Continuation of application No. 12/881,883, filed on Sep. 14, 2010, now Pat. No. 8,469,004.

(51) Int. Cl.
*F02M 61/14* (2006.01)

(52) U.S. Cl.
USPC ..... 123/470; 277/591

(58) Field of Classification Search
USPC ..... 123/468, 469, 470; 267/161, 165; 277/313, 591
See application file for complete search history.

(56) References Cited

U.S. PATENT DOCUMENTS

| | | | | |
|---|---|---|---|---|
| 2,730,155 | A | | 1/1956 | Knohl |
| 3,038,456 | A | | 6/1962 | Dreisin |
| 3,604,096 | A | * | 9/1971 | Shiroma ..... 29/235 |
| 4,887,637 | A | | 12/1989 | Ketner |
| 5,372,313 | A | | 12/1994 | Chabon et al. |
| 5,538,282 | A | | 7/1996 | White et al. |
| 5,788,161 | A | | 8/1998 | Potz et al. |
| 6,338,327 | B1 | | 1/2002 | Ogi et al. |
| 6,367,769 | B1 | | 4/2002 | Reiter |
| 6,578,554 | B2 | | 6/2003 | Schroeer |
| 6,866,026 | B2 | | 3/2005 | Mickelson |
| 7,293,550 | B2 | | 11/2007 | Beardmore |
| 7,331,331 | B2 | | 2/2008 | Hanawa et al. |
| 7,373,925 | B2 | | 5/2008 | Reiter et al. |
| 7,383,818 | B1 | | 6/2008 | Beardmore |
| 7,422,193 | B2 | | 9/2008 | Sisk et al. |
| 7,556,022 | B1 | | 7/2009 | Doherty et al. |

(Continued)

FOREIGN PATENT DOCUMENTS

DE 10126336 A1 12/2002

*Primary Examiner* — Thomas Moulis

(74) *Attorney, Agent, or Firm* — Julia Voutyras; Alleman Hall McCoy Russell & Tuttle LLP

(57) ABSTRACT

A direct fuel injection cylinder for an engine of a vehicle includes a direct fuel injector disposed in an injector bore within a cylinder head. A beveled conical wave washer is disposed between a shelf in the injector bore and a shoulder of the direct fuel injector. During operation of the vehicle, the beveled conical wave washer is elastically deformed by radial displacement caused by absorption of high frequency energy from the direct fuel injector. Elastic deformation of the beveled conical wave washer may reduce noise which may be caused by impact of the direct fuel injector and the cylinder head.

20 Claims, 4 Drawing Sheets

(56) References Cited

U.S. PATENT DOCUMENTS

| | | | | |
|---|---|---|---|---|
| 7,591,246 | B2 | 9/2009 | Beardmore et al. | |
| 7,600,502 | B2 | 10/2009 | Welzmueller et al. | |
| 7,640,917 | B2 | 1/2010 | Daniel et al. | |
| 7,665,198 | B2 | 2/2010 | Cho et al. | |
| 8,118,062 | B2 | 2/2012 | Spiers et al. | |
| 8,516,996 | B2 * | 8/2013 | Solferino et al. | 123/470 |
| 2001/0007338 | A1 | 7/2001 | Popp | |
| 2004/0003798 | A1 | 1/2004 | Mutschler | |
| 2005/0151310 | A1 * | 7/2005 | Rodeffer | 267/161 |
| 2006/0261663 | A1 * | 11/2006 | Sollami | 299/104 |
| 2007/0175451 | A1 | 8/2007 | Beardmore | |
| 2007/0274805 | A1 * | 11/2007 | Nebl et al. | 411/307 |
| 2008/0277009 | A1 | 11/2008 | Sprague | |
| 2009/0071445 | A1 | 3/2009 | Mueller et al. | |
| 2009/0235898 | A1 | 9/2009 | Short | |
| 2010/0006060 | A1 | 1/2010 | Hoefner | |
| 2012/0104120 | A1 | 5/2012 | Holt et al. | |

* cited by examiner

BEVELED DAMPENING ELEMENT FOR A FUEL INJECTOR

CROSS REFERENCE TO RELATED APPLICATIONS

The present application is a continuation of U.S. patent application Ser. No. 12/881,883 filed Sep. 14, 2010, now U.S. Pat. No. 8,469,004, the entire contents of each of which are incorporated herein by reference.

FIELD

The present application relates to a bevel isolator for attenuating noise caused by impact between a direct injector tip and a cylinder head in a direct injection engine of a vehicle.

BACKGROUND AND SUMMARY

Vehicles with direct injection engines typically include a fuel rail for delivery of pressurized fuel to a plurality of injectors, wherein each of the injectors is coupled to a cylinder head for direct injection of fuel into an engine cylinder. Due to high operating fuel pressure and direct coupling of injectors to cylinder heads, undesirable structureborne noise may be generated during idle operation of the vehicle. High frequency energy may be transmitted from the injector to the cylinder head. Specifically, a "ticking" noise may be generated because of high frequency energy caused by impact between the magnetic solenoid valve armature and stopper at injector opening, and pin and seat at injector closing. This noise may be audible to an operator when the engine is at idle, and produces little background noise.

In one approach, described in U.S. Patent Application Publication US2009/0071445, a steel dampening element is disposed between a conical region of injection valve and a cylinder head. The dampening element has a conical shape and a central pass through wherein the injector is fitted. A top portion of the dampening element includes an elevation, such as an annular flange, which abuts the injector. A diameter of the dampening element is less than a diameter of the cylinder head, such that a first gap is exists between the support element and the cylinder head. A second gap exists between a lower portion of the support element and the injector, below a line of contact/abutment between the injector and the annular flange. A force from the injector may bend the top portion of the dampening element outward generating radial displacement into the first gap in order to absorb a portion of the impact. Thus, during operation of the vehicle, periodic pulses of the injector are transferred to the cylinder head in an attenuated fashion.

The inventors herein recognize potential issues with such a configuration for a dampening element. As one example, an outer wall of the top portion of the previously described dampening element may impact an inner wall of the cylinder head at a specific line of contact during radial displacement. In cases where the cylinder head is comprised of aluminum, the steel dampening element may damage the inner wall of the cylinder head over time. In another example, much of the elastic deformation of the previously described dampening element may be absorbed at a joint between the upper portion and a lower portion. In this example, the joint may be weakened over time and may eventually be deformed or broken.

Thus, some of the above issues may be at least partly addressed by a direct fuel injection cylinder of an engine, comprising, a cylinder head including an injector bore with a shelf; a high-pressure direct injector disposed in the injector bore; and a spring washer disposed between the high-pressure direct injector and the shelf with the high-pressure direct injector positioned through a central pass-through of the spring washer, the spring washer forming a conical wall with a plurality of waves.

In this example, the spring washer includes a series of regular waves, and inner-facing troughs of the waves contact the injector in the non-compressed state. In order to absorb impact of the injector, each of the waves may be elastically deformed from the non-compressed state into the compressed state. Therefore, elastic deformation is distributed over a larger surface area than that of the previously described dampening element. In the compressed state, outer-facing crests of the waves may contact the cylinder head. Impact of the spring washer against the wall of the cylinder head is distributed over a larger surface area and may decrease damage to the inner wall of the cylinder head. Further, the cone may be elastically deformed by the introduction of hoop stress. As such, an angle at the intersection of an inner side of the spring washer and the shelf in the injector bore has first magnitude in the non-compressed state and a second magnitude in the compressed state. In this example, the first magnitude is less than the second magnitude.

In one specific example, a spring washer includes a conical wall encompassing a central pass-through, the conical wall comprising a plurality of regular waves. In this example, the waves are beveled such that a crest of a wave and a trough of a wave are substantially flat. The crests and the troughs are joined via connecting walls. The connecting walls intersect each of the crests and troughs at an equal angle, and the angle may be greater in the compressed state than the non-compressed state. As such, during operation of the direct injection fuel system, elastic deformation is absorbed by the dampening element at each of the lines of intersection between the angled flat portions and each of the crests and troughs. Further, the cone may absorb impact via hoop stress.

Combined these features provide a spring washer which distributes elastic deformation over a greater surface area, and therefore the spring washer may have increased durability. Additionally, impact of the spring washer against the surface of the cylinder head is distributed over a larger surface area, and therefore over time the spring washer may limit damage to the surface of the cylinder head.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
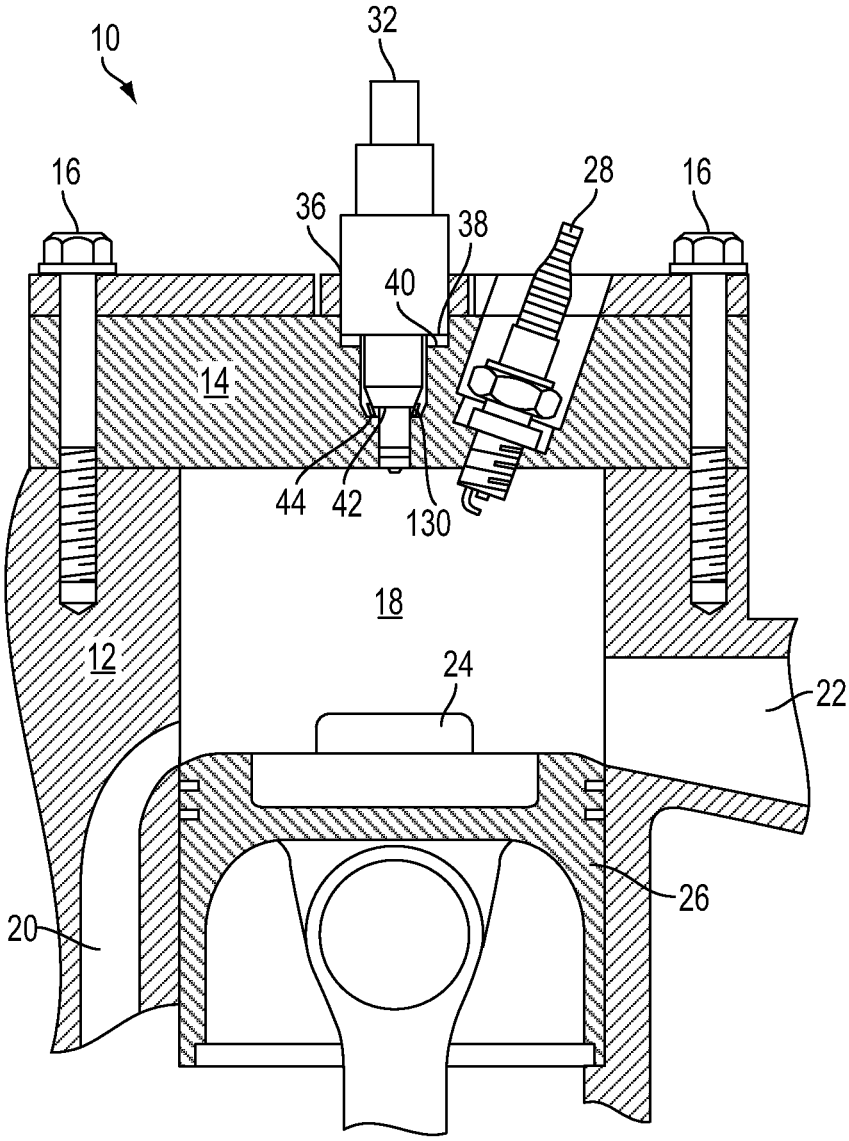
FIG. 1 includes an example embodiment of direct injection fuel cylinder.

The following description relates to a direct injection fuel cylinder for an engine of a vehicle, such as a direct injection gasoline engine. FIG. 1 shows an example embodiment of a direct injection fuel cylinder. The direct injection fuel cylinder comprises, in part, an injector coupled to a fuel rail and a cylinder head for delivery of pressurized fuel from the fuel rail into the cylinder. The injector is at least partially disposed in an injector bore within the cylinder head. Fuel may travel through an inlet of the injector coupled to the fuel rail and through a nozzle of the injector into a combustion chamber, wherein fuel may be burned to provide power to the engine.

Figure 2:
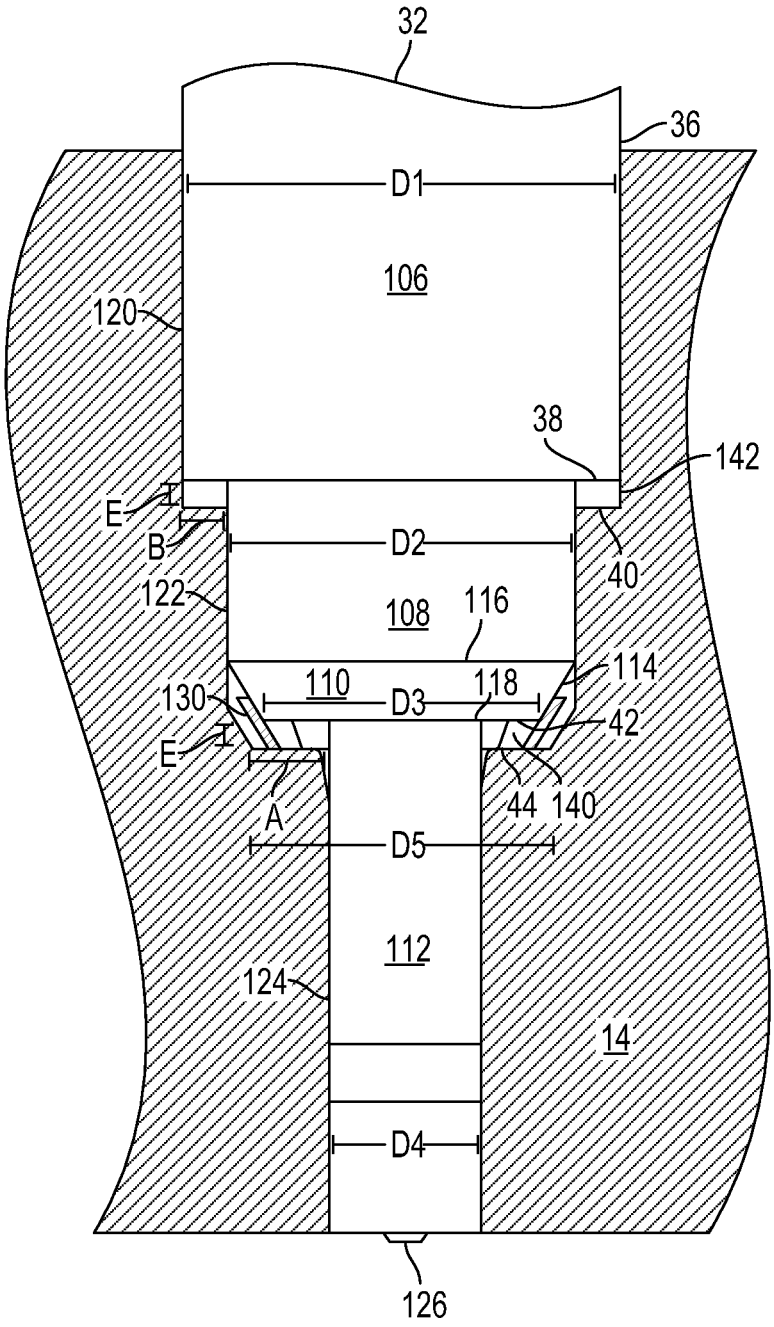
FIG. 2 shows a detailed depiction of the injector of FIG. 1 and the spring washer.

FIG. 2 shows a more detailed depiction of the injector and the injector bore of FIG. 1. The injector includes a cylindrical actuator portion, a cylindrical outer housing portion, and a cylindrical nozzle portion. The cylindrical outer housing has a larger diameter than the cylindrical actuator portion, creating an upper injector shoulder. The cylindrical actuator portion may have a larger diameter than the cylindrical nozzle portion, creating a lower injector shoulder. The lower injector shoulder may have a generally conical portion which is extended between a face of the injector shoulder and the main body of the actuator portion. The injector bore may include an upper shelf and a lower shelf with a shape and location complementary to those of the injector shoulder. The generally conical portion of the injector shoulder may be fitted to a generally conical wall of the cylinder head shelf. Thus, the location of the injector shoulder and the cylinder head shelf is an interface of between the actuator portion and the cylinder head. At the interface, the injector may transfer high frequency energy to the cylinder head and generate noise. A dampening element may be provided at the interface to reduce the generation of noise.

An example embodiment of a dampening element is a spring washer, the location of which is shown in FIG. 2. The spring washer may have a generally conical shape, having a larger diameter at a top side and a smaller diameter at a bottom side. The spring washer may be disposed between the conical portion of the injector shoulder and the conical wall of the injector bore. In this embodiment, the spring washer is a conical wave washer. The conical wave washer comprises a conical wall encompassing a central pass-through, wherein the injector nozzle may be disposed. An upper edge and inner wall of the conical wave washer may contact the conical portion of the injector shoulder, while a bottom side of the conical wave washer may contact the lower shelf of the cylinder head. The conical washer may radially expand as it experiences a downward force of the injector during fuel injection. Hoop stress may bend the cone outward, while waves absorb elastic deformation. The conical wave washer may maintain a gap between the injector and the cylinder head. Thus, the conical washer may prevent direct contact between the injector shoulder and the shelf of the cylinder head, and may decrease transfer of high frequency energy and generation of undesired noise.

Figure 3:
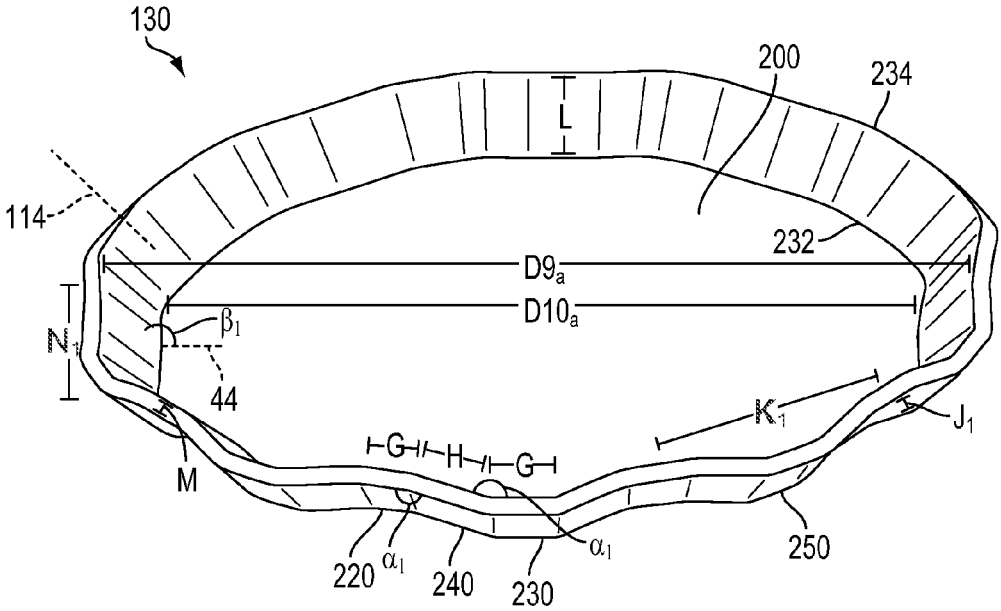
FIG. 3 shows a detailed depiction of the spring waster of FIG. 2 in a non-compressed state.
Figure 4:
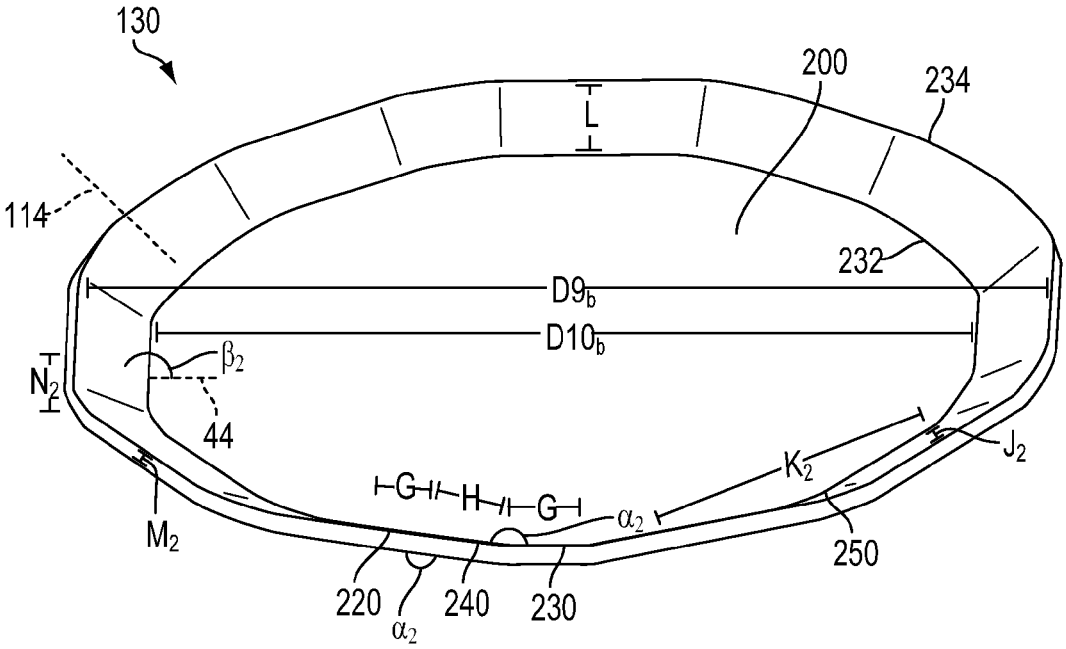
FIG. 4 shows a detailed depiction of the spring washer of FIGS. 2 and 3 in a compressed state.

As depicted in FIGS. 3 and 4, in this example embodiment, the conical washer includes waves of substantially equal wavelength and amplitude in the conical wall. In one embodiment, the waves comprise a plurality of crests, which may be axially extended toward a center of the central pass-through, and a plurality of troughs, which may be axially extended away from the center of the central pass-through. In this example, an upper edge of the conical wave washer contacts the conical portion of the injector at each of the crests and a lower edge of the wave washer contacts the cylinder head shelf.

Further, in the embodiment of FIGS. 3 and 4, the conical wave washer is beveled, such that the crests and troughs are substantially flat and joined by connecting walls. Such a conformation for a dampener may be advantageous in that elastic deformation of the wave washer may be absorbed at an intersection of each of connecting walls with each of the crests and troughs, increasing the durability of the dampener. Additionally, the dampener may absorb elastic deformation by hoop stress of the cone. As an example and in order to demonstrate elastic deformation of the conical wave washer, the conical wave washer is shown in a non-compressed state in FIG. 3 and in a compressed state in FIG. 4. Moreover, in the compressed state, impact of the wave washer against an inner wall of the cylinder head may be distributed over a greater surface area and decrease damage to the inner wall of the cylinder head. All figures are drawn approximately to scale.

FIG. 1 shows an engine 10 including a cross section of cylinder block 12 and cylinder head 14. A combustion chamber 18 is formed in a cavity of the cylinder block 12 and is closed on one side by capping with the cylinder head 14. The cylinder head 14 is mounted in the cylinder block 12 in an air tight manner. In this example embodiment the cylinder head 14 is mounted via two studs 16. In other embodiments, the cylinder head 14 may be mounted via other means or may be integrally formed with the cylinder block 12.

A booster port 20 and a scavenging port 24 are coupled to the combustion chamber 18 and may introduce fresh air including lubrication oil to the combustion chamber 18. Also, an exhaust port 22 is coupled to the combustion chamber 18 for discharging exhaust gas therethrough. The exhaust port 22 is provided on a side of the combustion chamber 18 opposing the booster port 20, while the scavenging port 24 is provided therebetween.

Opening and closing of each of the booster port 20, the scavenging port 24, and the exhaust port 22 is regulated by the reciprocating motion of a piston 26. As the piston 26 moves up, the ports are closed. As the piston 26 moves down, the ports are opened. Movement of the piston 26 is actuated by a crank shaft (not shown). Additionally, the piston 26 forms the bottom of the combustion chamber 18.

A spark plug 28 is at least partially disposed in a spark plug bore 30 within the cylinder head 14. The spark plug bore 30 is located at a side of combustion chamber 18, proximal to the exhaust port 22. The spark plug bore 30 is angled through the cylinder head 14 and an electrode 34 of the spark plug 28 is exposed in the combustion chamber 18. The spark plug 28 may ignite fuel spray so that the fuel may be burned in the combustion chamber 18. Accordingly, an injector 32 is provided proximal to the spark plug 28.

The injector 32 is a component of a high pressure fuel system. The high pressure fuel system may additionally include a lift pump (not shown), a high pressure pump (not shown), and a fuel rail (not shown). The lift pump may draw fuel from a fuel supply (not shown) and fuel may be pressurized by the high pressure pump. Fuel may be delivered to the injector via the fuel rail coupled to an outlet of the high pressure fuel pump.

The injector 32 is at least partially disposed in an injector bore 36. The injector bore 36 includes a lower shelf 44, wherein a lower shoulder 42 of the injector 32 may be abutted. Additionally, the injector bore 36 includes an upper shelf 40, wherein an upper shoulder 38 of the injector may be abutted. Both of these interfaces may provide a support surface so that the injector 32 may not move further into the combustion chamber 18. During operation of the engine 10, pressurized fuel enters the injector 32 from the fuel rail (not shown). The high pressure flow of fuel may cause the injector to impact the cylinder head at the locations of the lower shelf 44 and the lower shoulder 42, and the upper shelf 40 and upper shoulder 38. Noise generation may be attenuated by including a dampening element within the injector bore 36, such as a conical wave washer. An example embodiment of a conical wave washer 104 is shown in FIGS. 2 and 3. It may be appreciated that the configuration of the fuel cylinder may include more or fewer components in alternate arrangements without departing from the scope of the present application.

FIG. 2 shows a detailed view the injector 32 and a portion cross section of the cylinder head 14 which includes the injector bore 36 from the example embodiment of FIG. 1. In this view, the injector comprises a main body which is an actuator 108, an outer housing 106 encompassing a portion of the actuator 108, a nozzle 112, and a tip 126 which are all cylindrical in shape. A conical portion 110 is disposed between the actuator 108 and the nozzle 112.

The outer housing 106 has a diameter $D_1$, the actuator 108 and a top face 116 of the conical portion 110 have a diameter $D_2$, a bottom face 118 of the conical portion 110 has a diameter $D_3$, and the nozzle 112 has a diameter $D_4$. Diameter $D_2$ is greater than diameter $D_3$, such that an angled wall 114 of the conical portion 110 is formed between the actuator 108 and the bottom face of the conical portion 110. The diameter $D_3$ is greater than diameter $D_4$, such that the lower shoulder 42 is formed between the nozzle 112 and the bottom face 118 of the conical portion 110. Thus, a radial length A of the lower shoulder 42 is equal to the difference between diameter $D_3$ and diameter $D_4$.

As stated above, the outer housing 106 of the actuator 108 has the diameter $D_1$. Diameter $D_1$ is greater than diameter $D_2$, and the upper shoulder 38 is formed where the outer housing 106 stops on the main body of the actuator 108. Thus, a radial length B of the upper shoulder 38 is equal to the difference between diameter $D_1$ and diameter $D_2$.

The injector bore 36 is complementary in shape and size to the injector 32. As such, the injector bore 36 has a generally stepped configuration. The outer housing 106 may be fitted into an upper portion 120, which is the widest portion of the injector bore 36. The upper portion 120 substantially has the diameter $D_1$. The actuator 108, where it is not covered by the outer housing 106, may be fitted into a mid portion 122 of the injector bore 36. The mid portion 122 substantially has the diameter $D_2$. As above, diameter $D_2$ is less than diameter $D_1$, such that the upper shelf 40 is formed at the intersection of the upper portion 120 and the mid portion 122. Thus, the upper shelf 40 substantially has the radial distance B which is equal to the difference between diameter $D_1$ and diameter $D_2$. The nozzle 112 may be fitted into a lower portion 124, which is the narrowest portion of the injector bore 36. The lower portion 124 substantially has the diameter $D_4$.

An angled wall 128 is included in the mid portion 122, proximal to the lower portion 124. The conical portion 110 of injector 32 may be fitted into the mid portion 122 at the location of the angled wall 128. A bottom of the mid portion 122, at lower shelf 44, has a diameter $D_5$. Diameter $D_5$ is less than diameter $D_2$ and greater than diameter $D_4$. Thus, the width of the mid portion 122 narrows at the location of the angled wall 128, and the lower shelf 44 is formed at an intersection of the mid portion 122 and the lower portion 124. The lower shelf 44 has a radial distance D, which is equal to the difference between diameter $D_5$ and diameter $D_2$.

A conical wave washer 130 is disposed between the conical portion 110 of the injector 32 and the angled wall 128 of the injector bore 36. The conical wave washer 130 may be comprised of steel or another desired metallic material. Further, in some embodiments, the conical wave washer may be comprised of plastic. A top edge 234 (shown in FIG. 3) of the conical wave washer 130 contacts the conical portion 110. A bottom edge 232 (shown in FIG. 3) of the conical wave washer 130 contacts the lower shelf 44. The injector 32 is disposed through a central pass-through 200 (shown in FIG. 3) of the conical wave washer 130.

The conical wave washer 130 is shown in the non-compressed state in FIG. 3. The top edge 234 has a diameter $D_9a$ and the bottom edge 232 has a diameter $D_{10a}$. The diameter $D_9a$ is greater than the diameter $D_3$ and less than the diameter $D_2$. Thus, the conical portion 110 is only partially disposed within a central pass-through 200 of the conical wave washer 130, as depicted in FIG. 2. A gap 140 has a height E and is disposed between the bottom wall 116 of the actuator and the lower shelf 44. In the present embodiment, a gap 142 also has a height E and is disposed between the bottom wall of the outer housing 106 and the upper shelf 40. In alternate embodiments, gap 142 may have a distance that is not equal to height E. In additional alternate embodiments, the outer housing of the injector and upper portion of the injector bore may be eliminated, and thus the upper shoulder, upper shelf, and gap therebetween may be eliminated.

As depicted in FIG. 3, the conical wave washer 130 includes a plurality of crests, such as crest 230, which are radially extended away from a center of central pass-through 200. The conical wave washer 130 also includes a plurality of troughs, such as trough 220, which are extended towards a center of central pass-through 200. In the present embodiment, the conical wave washer 130 has beveled configuration, and therefore crests and troughs, such as crest 230 and trough 220, are substantially flat. In alternate embodiments, the conical wave washer may include rounded waves.

Each of the adjacent crests and troughs are joined by a connecting wall, such as a connecting wall 240. The connecting wall 240 is extended between adjacent ends of the crest 230 and the trough 220, and intersects each of the crest 230 and the trough 220 at an angle $\alpha_l$. In alternate embodiments, the angle of intersection between the crest and the connecting wall may vary from the angle of intersection between the connecting wall and the trough.

In the present embodiment, the crest 230 and the trough 220 have a width G (a 1:1 ratio), while the connecting wall 240 has a width H. Width H is approximately two times width G (a 2:1 ratio). In alternate embodiments, the ratio between widths of the crests and troughs may vary. Further, the ratio between the crests and/or the troughs and the connecting walls may vary. For example, the troughs may have a width that is approximately one half the width of the crests (a 2:1 ratio), while the angled walls are the same width as the crests (a 1:1 ratio).

A wave 250, has a wavelength $K_1$ and an amplitude $J_1$. The wavelength $K_1$ and the amplitude $J_1$ are both dependent on the widths of the crests and troughs and the degree of the angle $\alpha_l$. In alternate embodiments, if widths G and H are increased and/or if the angle $\alpha_1$ is increased, then the wavelength $K_1$ may be increased. In other alternate embodiments, if the widths G and H are decreased and/or if the angle $\alpha_1$ is decreased, then the overall the wavelength $K_1$ may be decreased. Further, if the width H is increased and/or the angle $\alpha_1$ is decreased, then the amplitude $J_1$ may be increased. Further still, if the width H is decreased and/or the angle $\alpha_1$ is increased, then the amplitude $J_1$ may be decreased.

As depicted in FIG. 3, the conical wave washer 130 has a uniform thickness, a thickness M. Thickness M is approximately one third of width G. In alternate embodiments, thickness M may be varied depending on the required resistance/elasticity of the conical wave washer. Further, the thickness of the conical wave washer may be varied at different locations of the conical wave washer. For example, the troughs and crests may have a greater thickness than the connecting walls.

Each of the crests, the troughs, and the connecting walls has a length L. The conical wave washer 130 has an overall height $N_1$. The overall height $N_1$ is dependent on the length L and a magnitude of an angle of intersection, an angle $\beta_1$. As such, the angle $\beta_1$ includes an angle between the bottom edge 232 and the lower shelf 44. In alternate embodiments, if length L is increased and/or if the angle $\beta_1$ is decreased, then the overall height $N_1$ may be increased. In other alternate embodiments, if the length L is decreased and/or if the angle $\beta_1$ is increased, then the overall height $N_1$ may be decreased.

During operation of the vehicle, high pressure fuel may be injected through the injector and into the combustion chamber. High frequency energy may be generated from the direct injection process and cause the injector to transmit high frequency energy. In an embodiment wherein the direct injector excludes a dampening element, the injector actuator may impact the lower shelf and/or the upper shelf of the injector bore within the cylinder head. At idle conditions, background noise from the engine is low, therefore the impact may be noticeable to an operator, as an undesirable ticking noise. In the present embodiment, the conical wave washer 130 may attenuate the ticking noise to a desirable noise level.

The conical wave washer 130 may attenuate noise via absorbing the high frequency energy. The high frequency energy may be absorbed by hoop stress of the cone and elastic deformation of the waves as the conical wave washer moves from a non-compressed state to a compressed state. In both cases, the conical wave washer is radially displaced. By introduction of hoop stress to the conical wave washer 130 in the compressed configuration, the angle $\beta_1$ may increase while the overall height $N_1$ decreases. Additionally, during elastic deformation of the waves, the angle $\alpha_1$ and the wavelength $K_1$ may increase while the amplitude $J_1$ is decreased in the compressed state. In the compressed state, the injector 32 may be further disposed within the conical wave washer 130 than is shown in the non-compressed state of FIG. 2. As such, distance E of gap 140 and gap 142 may be decreased in the compressed state, but the gaps may still be maintained so that the injector 32 may be prevented from contacting the cylinder head 14.

An example embodiment of the conical wave washer 130 in the compressed state is shown in FIG. 4. Elastic deformation of the conical wave washer 130 may be demonstrated through comparison of FIGS. 3 and 4. In the compressed state, the bevels of the walls of the conical wave washer 130 approach a flat configuration (non-beveled). In this example, a magnitude of an angle $\alpha_2$ in the compressed state is greater than the magnitude of the angle $\alpha_1$ in the non-compressed state, and a magnitude of an angle $\beta_2$ in the compressed state is greater than the magnitude of the angle $\beta_1$ in the non-compressed state. In this example, the magnitude of the angle $\alpha_2$ may approach 180°.

Further, an overall height $N_2$ of the conical wave washer in the compressed configuration is less than the overall height $N_1$ of the conical wave washer in the non-compressed configuration. Similarly, the amplitude $J_2$ of the conical wave washer in the compressed state is less than the amplitude $J_1$ of the conical wave washer in the non-compressed state. Furthermore, a wavelength $K_2$ of the example wave 250 in the compressed state is greater than the wavelength of the wave 250 in the non-compressed state.

Further still, each of diameters $D_{9b}$ and $D_{10b}$ may increase to a distance greater than diameters $D_{9a}$ and $D_{10b}$, respectively. The difference between diameter $D_{9b}$ and $D_{9a}$ ($\Delta D_9$) may be a result of radial expansion of the beveled waves in the compressed state. The difference between diameter $D_{10b}$ and $D_{10a}$ ($\Delta_{10}$) may be a result of radial expansion to the beveled waves and/or hoop stress introduced to the cone. Therefore, in the present embodiment, $\Delta D_{10}$ may be greater than $\Delta D_9$.

In the present embodiment, as stated above and shown in FIGS. 2 and 3, the dampening element is a conical wave washer. The conical wave washer may attenuate noise generated by the impact of the injector in the cylinder head via hoop stress of the cone and elastic deformation of the waves. In alternate embodiments, the dampening element may be a conical washer which lacks waves. In this embodiment, the dampening element may be disposed in the same location in the same location as the conical wave washer and attenuate noise via hoop stress of the cone. In an additional embodiment, the dampening element may be a wave washer, which lacks an overall conical shape. In this additional embodiment, the wave washer may be disposed in an alternate location, between the upper shoulder of the injector and the upper shelf of the cylinder head. Further, the wave washer may attenuate noise via elastic deformation of the waves.

The above description characterizes a dampening element for a direct injection fuel injector of a vehicle. The dampening element is a conical wave washer. Use of a conical wave washer in direct injection noise attenuation may have the advantages of having a greater surface area for contacting the injector and the cylinder head and having greater distribution of elastic deformation over previously described dampening elements. These features of a conical wave washer contribute to the dampening element causing decreased damage to the cylinder head and increasing the durability of the dampening element.

It will be appreciated that the configurations disclosed herein are exemplary in nature, and that these specific embodiments are not to be considered in a limiting sense, because numerous variations are possible. For example, the above technology can be applied to various types of vehicles, such as cars or trucks. In another example, the technology can be applied to hybrid vehicle or a combustion engine only vehicle. Further, the technology can be applied to stationary engines. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A direct fuel injection cylinder of an engine, comprising:

a cylinder head including an injector bore with a shelf;

a high-pressure direct injector disposed in the injector bore; and a spring washer disposed between the injector and the shelf with the injector positioned through a central pass-through of the washer, the washer forming a conical wall with a plurality of waves including radially extended crests and troughs.

2. The direct fuel injection cylinder of claim 1, wherein the spring washer is movable between a non-compressed state and a compressed state.

3. The direct fuel injection cylinder of claim 1, wherein the spring washer has a first diameter at a first edge of the conical wall and a second diameter at a second edge of the conical wall, the first diameter greater than the second diameter, the first edge proximal to the high-pressure direct injector, the second edge proximal to the shelf.

4. The direct fuel injection cylinder of claim 1, wherein the crests radially extend outwards away from a center of the central pass-through, and the troughs radially extend inwards towards the center of the central pass-through.

5. The direct fuel injection cylinder of claim 4, wherein the waves are beveled, such that the crests and the troughs are substantially flat, and where an adjacent crest and trough are joined via a connecting wall.

6. The direct fuel injection cylinder of claim 5, wherein the connecting wall intersects each of the adjacent crest and the trough at a substantially equal angle, the angle formed between an inner side of the crest and the connecting wall and between an outer side of the trough and the connecting wall.

7. The direct fuel injection cylinder of claim 6, wherein the angle has a first magnitude in the non-compressed state, and the angle has a second magnitude in the compressed state, the second magnitude greater than the first magnitude.

8. The direct fuel injection cylinder of claim 4, wherein the troughs are abutted to a surface of the injector on an inner surface of the conical wall.

9. The direct fuel injection cylinder of claim 1, wherein the waves have substantially equal amplitude.

10. The direct fuel injection cylinder of claim 9, wherein the waves have a first amplitude in the non-compressed state, and a second amplitude in the compressed state, the first amplitude greater than the second amplitude.

11. The direct fuel injection cylinder of claim 1, wherein the waves have substantially equal wavelength.

12. The direct fuel injection cylinder of claim 11, wherein the waves have a first wavelength in the non-compressed state, and a second wavelength in the compressed state, the first wavelength less than the second wavelength.

13. The direct fuel injection cylinder of claim 1, wherein an intersection of the conical wall and the shelf has an angle on an inner side of the spring washer, the angle having a first magnitude in the non-compressed state, the angle having a second magnitude in the compressed state, the second magnitude greater than the first magnitude.

14. The direct fuel injection cylinder of claim 1, wherein the spring washer is comprised of steel.

15. A method for dampening direct fuel injector pulsations in an engine, comprising:

injecting fuel directly into a cylinder of the engine via the injector, the injector positioned in a head injector bore opposite a piston, the head injector bore including a shelf;

elastically deforming a conical beveled spring washer disposed between the injector and the shelf, elastic deformation including outward expansion of a conical wall in addition to flattening of bevels in the conical wall.

16. The method of claim 15, wherein the conical spring washer is movable between a compressed and a non-compressed state, and the injector is disposed in a central pass-through of the conical spring washer, the conical spring washer being in the compressed state when a force is applied on the conical spring washer from the injector, and the conical spring washer being in the non-compressed state when the force is removed from the conical spring washer.

17. The method of claim 16, wherein the plurality of bevels comprise, a plurality of crests, the plurality of crests radially extended inwards toward a center of the central pass-through;

a plurality of troughs, the plurality of troughs radially extended outwards from the center of the central pass-through; and a plurality of connecting walls, each of the plurality of connecting walls joining an adjacent crest and an adjacent trough, an angle between an inner wall of the adjacent crest and a connecting wall being substantially equal to an angle between an outer wall of the adjacent trough and the connecting wall, the angle having a first magnitude in the non-compressed state and a second magnitude in the compressed state, the second magnitude greater than the first magnitude.

18. The method of claim 16, wherein the conical wall includes a first edge and a second edge, the first edge contacting the injector, the second edge contacting the shelf.

19. The method of claim 18, wherein the first edge has a first diameter and the second edge has a second diameter in the non-compressed state, and the first edge has a third diameter and the second edge has a fourth diameter in the compressed state, the first diameter greater than the third diameter, the second diameter greater than the fourth diameter, a difference between the first diameter and the third diameter greater than a difference between the second diameter and the fourth diameter.

20. A direct fuel injection cylinder of an engine, comprising:

a cylinder head including an injector bore with a shelf;

a high-pressure direct injector disposed in the injector bore; and a steel spring washer disposed between the injector and the shelf with the injector positioned through a central pass-through of the washer, the washer forming a conical wall with a plurality of waves including radially extended beveled crests and troughs.

* * * * *